US006601969B2

(12) United States Patent
Barton

(10) Patent No.: US 6,601,969 B2
(45) Date of Patent: Aug. 5, 2003

(54) REMOVABLE MAILBOX LIGHT

(76) Inventor: James C. Barton, 1658 Smyrna Rd., Keatchie, LA (US) 71046

( * ) Notice: Subject to any disclaimer, the term of this patent is extended or adjusted under 35 U.S.C. 154(b) by 200 days.

(21) Appl. No.: 09/832,996

(22) Filed: Apr. 10, 2001

(65) Prior Publication Data

US 2002/0145868 A1 Oct. 10, 2002

(51) Int. Cl.[7] ..... F21V 33/00
(52) U.S. Cl. ..... 362/155; 362/802; 362/191
(58) Field of Search ..... 362/155, 154, 362/156, 802, 190, 191, 396; 232/13, 17, 25

(56) References Cited

U.S. PATENT DOCUMENTS

| | | | | | |
|---|---|---|---|---|---|
| 1,056,393 A | * | 3/1913 | Bartley | ..... | 362/184 |
| 1,819,398 A | * | 8/1931 | Wegehoft | ..... | 362/154 |
| 1,842,597 A | * | 1/1932 | Foti | ..... | 40/566 |
| 4,648,012 A | | 3/1987 | Pittman | ..... | 362/155 |
| 4,755,915 A | | 7/1988 | Rogers | ..... | 362/155 |
| 5,975,713 A | | 11/1999 | Brothers | ..... | 362/155 |
| 6,033,084 A | | 3/2000 | Burke | ..... | 362/155 |
| 6,102,548 A | | 8/2000 | Mantle et al. | ..... | 362/155 |

* cited by examiner

*Primary Examiner*—Sandra O'Shea
*Assistant Examiner*—Sharon Payne
(74) *Attorney, Agent, or Firm*—R. Keith Harrison

(57) ABSTRACT

A removable mailbox light which can be quickly, easily and removably attached to a mailbox for illuminating the mailbox interior when the mailbox door is opened. In a preferred embodiment, the removable mailbox light is characterized by a housing fitted with an attachment clip for removably attaching the housing to the mailbox, with the housing disposed in the mailbox interior. The housing contains a pair of batteries, and a light bulb disposed in electrical contact with the batteries extends from the front end of the housing adjacent to a beveled, concave or dish-shaped reflection surface. When the mailbox door is closed, a spring-loaded activation clip pivotally mounted in the rear end of the housing is pressed against the housing and breaks electrical contact between the batteries to extinguish the light bulb. Upon opening of the mailbox door, the activation clip assumes an extended configuration and establishes electrical contact between the batteries to energize the light bulb and illuminate the mailbox interior.

12 Claims, 3 Drawing Sheets

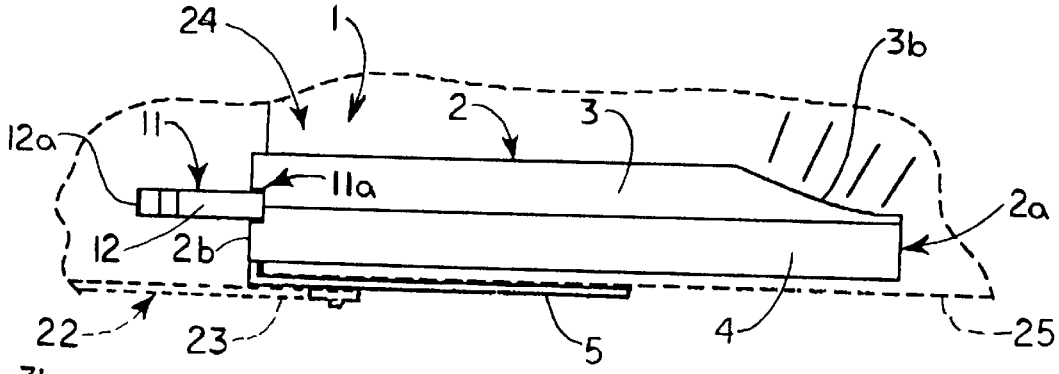
FIG. 4
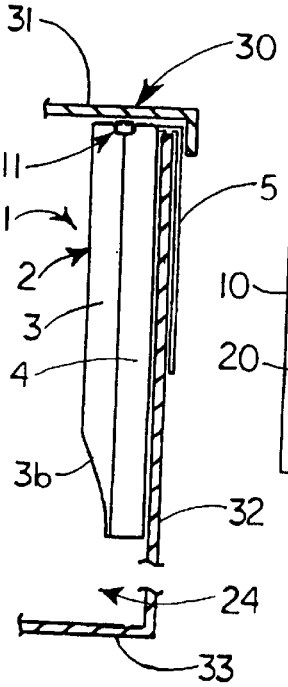
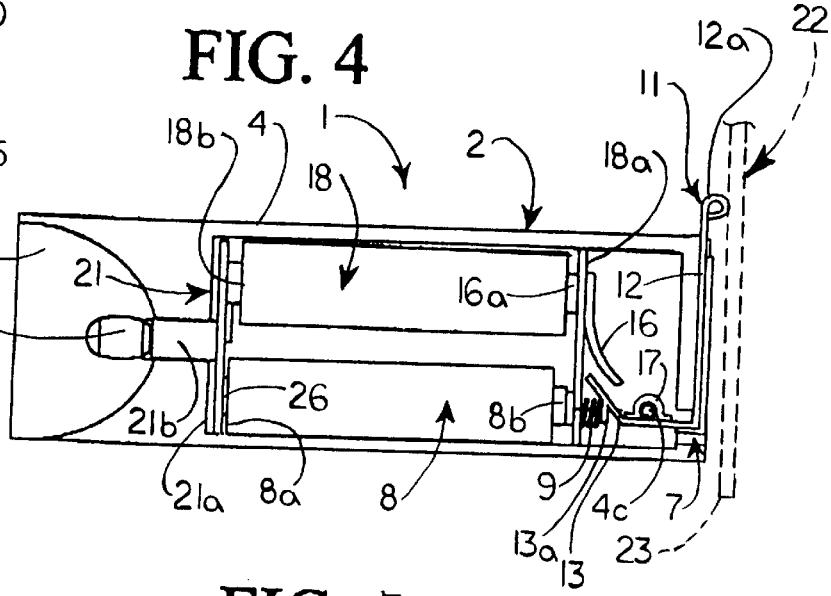
FIG. 5
FIG. 7
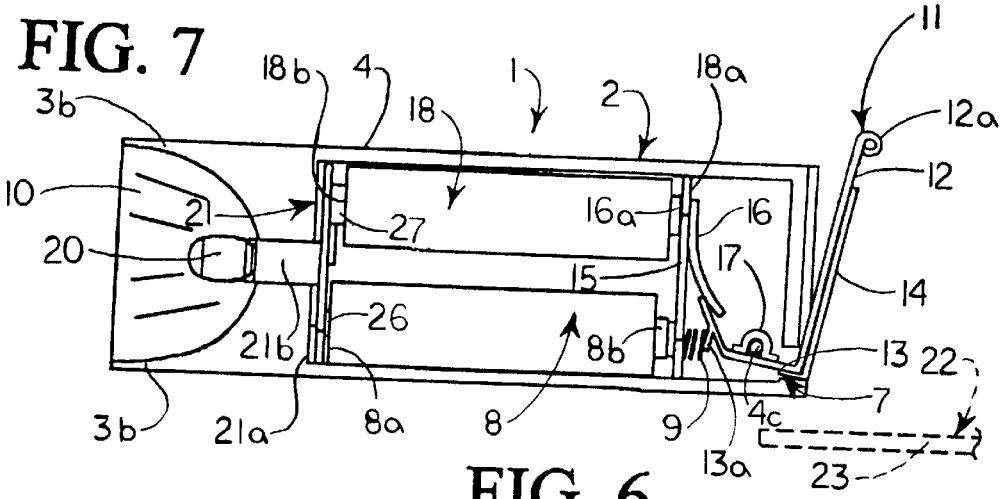
FIG. 6

REMOVABLE MAILBOX LIGHT

BACKGROUND OF THE INVENTION

1. Field of the Invention

This invention relates to accessories for mailboxes and more particularly, to a removable mailbox light which can be quickly and easily removably installed on a mailbox to facilitate illuminating and viewing the interior of the mailbox when the mailbox door is opened. In a preferred embodiment, the removable mailbox light includes an elongated housing having a beveled, concave or dish-shaped reflection surface at the front end thereof and a light bulb extending from the housing adjacent to the reflection surface. An attachment clip is provided on the housing to facilitate removable attachment of the housing to the mailbox wall, with the housing disposed inside the mailbox interior. A first battery and a second battery in the housing are both provided in electrical contact with the light bulb, and an activation clip pivotally mounted in the rear end of the housing is disposed in electrical contact with the first battery through a contact spring. When closed, the mailbox door presses the activation clip against the housing and the activation clip disengages the second battery, breaking electrical contact between the batteries in the housing such that the light bulb extinguished. Upon opening of the mailbox door, the contact spring in the housing urges the activation clip into an extended configuration from the housing and into electrical contact with the second battery, such that the electrical circuit is completed and the light bulb is energized, illuminating the mailbox interior.

While mail is typically delivered during daylight hours in the United States, persons may retrieve mail from their mailboxes in the late evening, during hours of darkness. Consequently, it is frequently necessary to hand-feel the dark mailbox interior to ensure that all the delivered mail has been retrieved from the mailbox. This, however, has limitations since important mail-delivered notices such as those appearing on flat postcards or sheets of paper can evade detection by feel and thus, inadvertently remain in the mailbox. Moreover, many persons are reluctant to thrust their hands into dark mailboxes for fear of striking sharp objects or unwittingly encountering spiders or insects.

Mailbox lights of various design are known in the art for illuminating the dark interior of a mailbox. U.S. Pat. No. 4,648,012, dated Mar. 3, 1987, to Pittman, describes an "Interior Light for U.S. Mailbox", characterized by an incandescent lamp depending from the top of the mailbox, which lamp is wired to a dry cell battery contained in an insulated case mounted beneath the bottom of the mailbox and to a push button on-off switch mounted on the latch at the front end of the mailbox. When the mailbox door is closed, the push button on-off switch is depressed and maintains the circuit between the battery and the extinguished lamp in an open configuration. When the mailbox door is opened, the push button on-off switch is extended and closes the circuit, thereby energizing the lamp.

A "Self-Contained Lighting Apparatus" is detailed in U.S. Pat. No. 4,755,915, dated Jul. 5, 1988, to Rogers. The apparatus is characterized by a lighting fixture with self-contained batteries and a mercury switch for attachment to the interior surface of a mailbox door and illuminating the mailbox interior when the mailbox door is opened. The mercury switch is manually adjustable about a lateral axis such that the fixture may be used on either front-opening or top-tilting doors.

U.S. Pat. No. 5,975,713, dated Nov. 2, 1999, to Brothers, discloses an "Interior Mailbox Light", characterized by a housing adapted to be affixed to the interior of a mailbox and an illumination source provided in the housing; a mount for affixing the the housing to the mailbox; a magnetic switch for lighting the illumination source, the switch operating in an "of" state and an "on" state; and a magnet affixed to the door, which magnet activates the magnetic switch to light the illumination source when the mailbox door is opened, and inactivates the magnetic switch to extinguish the illumination source when the mailbox door is closed.

U.S. Pat. No. 6,033,084, dated Mar. 7, 2000, to Burke, describes a "Retrofittable Mailbox Light System", including a housing having a releasable coupling mechanism for mounting the housing on a mailbox, with a front face of the housing remaining flush with the open front of the mailbox A lamp is mounted to the housing for illuminating the interior space of the mailbox, and a battery is positioned in an interior space of the housing. A momentary switch mounted to the housing and connected between the lamp and the battery is adapted for supplying the lamp with power only upon the release of the switch when the lid of the mailbox is opened.

A "Lighting System for Mailbox" is disclosed in U.S. Pat. No. 6,102,548, dated Aug. 15, 2000, to Mantle, et al. The Mantle lighting system includes a light source and battery positioned in the interior of a mailbox. A light sensor is capable of sensing the level of ambient light in the mailbox, and an electromagnetic sensor permits current from the power source to be transmitted to the light sensor upon opening the mailbox door. If the level of ambient light sensed by the light sensor is below a predetermined level the light source is energized to illuminate the mailbox interior. Current to the light sensor and light source is interrupted upon closing the mailbox door.

An object of the present invention is to provide a new and improved mailbox light for quick, easy and removable attachment to a mailbox.

Another object of this invention is to provide a removable mailbox light which is disposable and simple in construction.

Another object of this invention is to provide a removable mailbox light which can be quickly and easily removably installed on a mailbox to facilitate illuminating and viewing the contents of the mailbox in a dark environment when the mailbox door is opened.

Still another object of this invention is to provide a mailbox light which is capable of quick, easy and removable attachment to post-mounted type mailboxes or porch-type mailboxes for illuminating the mailbox interior upon opening of the mailbox.

A still further object of this invention is to provide a new and improved removable mailbox light which is capable of substantially uniformly illuminating the entire interior of a mailbox.

Yet another object of the invention is to provide a mailbox light characterized by a housing having an attachment clip for removably attaching the housing to a mailbox, with the housing disposed in the mailbox interior; a battery provided in the housing; a light bulb extending from the front end of the housing in electrical contact with one terminal of the battery; and an activation clip provided in the rear end of the housing for reversibly establishing electrical contact between the light bulb and the other terminal of the battery, wherein the activation clip is pressed against the housing and breaks electrical contact between the battery and the light bulb to extinguish the light bulb when the mailbox door is closed, and upon opening of the mailbox door the activation clip extends away from the housing and establishes electrical contact between the battery and the light bulb to energize the light bulb and illuminate the mailbox interior.

Yet another object of the invention is to provide a removable mailbox light which can be quickly, easily and removably attached to a mailbox for illuminating the mailbox interior when the mailbox door is opened, which removable mailbox light is characterized by a housing fitted with an attachment clip for removably attaching the housing to the wall of the mailbox, with the housing disposed in the mailbox interior; a pair of batteries provided in the housing; a light bulb extending from the front end of the housing in electrical contact with the batteries and adjacent to a beveled, concave or dish-shaped reflection surface of the housing; an activation clip provided at the rear end of the housing, which activation clip is pressed against the housing to break electrical contact between the batteries and extinguish the light bulb when the mailbox door is closed, and which activation clip assumes an extended configuration from the housing and establishes electrical contact between the batteries to energize the light bulb and illuminate the mailbox interior upon opening of the mailbox door.

A still further object of the invention is to provide a new and improved removable mailbox light for quick, easy and removable attachment to mailboxes of various design, which removable mailbox light is characterized by an elongated housing; an attachment clip provided on the housing for removably attaching the housing to the wall of the mailbox with the housing disposed in the mailbox interior; a light bulb extending from the front end of the housing adjacent to a beveled, concave or dish-shaped reflection surface of the housing; a first battery and a second battery provided in the housing in electrical contact with the light bulb; a contact spring provided in the housing in electrical contact with the first battery; and an activation clip pivotally mounted in the rear end of the housing and engaging the contact spring for reversibly establishing electrical contact between the first battery and the second battery, wherein the activation clip is pressed against the housing against the bias of the contact spring and disengages the second battery to break electrical contact between the first battery and the second battery and extinguish the light bulb when the mailbox door is closed, and the contact spring urges the activation clip into contact with the second battery to establish electrical contact between the first battery and the second battery and energize the light bulb, upon opening of the mailbox door.

SUMMARY OF THE INVENTION

These and other objects of the invention are provided in a new and improved removable mailbox light which can be quickly, easily and removably attached to a mailbox for illuminating and viewing the mailbox interior when the mailbox door is opened. In a preferred embodiment, the removable mailbox light is characterized by a housing fitted with an attachment clip for removably attaching the mailbox light to the mailbox, with the housing disposed in the mailbox interior. The housing contains a pair of batteries, and a light bulb extending from the front end of the housing adjacent to a beveled, concave or dish-shaped reflection surface is provided in electrical contact with the batteries. When the mailbox door is closed, a spring-loaded activation clip at the rear end of the housing is pressed against the housing and breaks electrical contact between the batteries to extinguish the light bulb. Upon opening of the mailbox door, the activation clip assumes an extended configuration and establishes electrical contact between the batteries to energize the light bulb and illuminate the mailbox interior.

BRIEF DESCRIPTION OF THE DRAWINGS

The invention will be better understood by reference to the accompanying drawings, wherein:

FIG. 4 is a top view of the removable mailbox light illustrated in FIG. 1, mounted on the mailbox (partially in section and in phantom) and illuminating the mailbox interior;

FIG. 5 is an interior view of the right housing panel element of the removable mailbox light, mounted on the mailbox, with a preferred battery assembly for energizing the light bulb element, and the mailbox door (in phantom) in the closed position and the activation clip element shown breaking electrical contact between the batteries of the battery assembly to extinguish the light bulb;

FIG. 6 is an interior view of the right housing panel element of the removable mailbox light, illustrated in FIG. 5, with the mailbox door (in phantom) shown in the open position and the extended, spring-loaded activation clip element of the light shown establishing electrical contact between the batteries to energize the light bulb;

FIG. 7 is a side view, partially in section, of a porch-type mailbox, with the removable mailbox light of this invention shown removably attached to the front wall of the mailbox in the mailbox interior, the mailbox lid in the closed position and the removable mailbox light extinguished;

DESCRIPTION OF THE PREFERRED EMBODIMENTS

Figure 1:
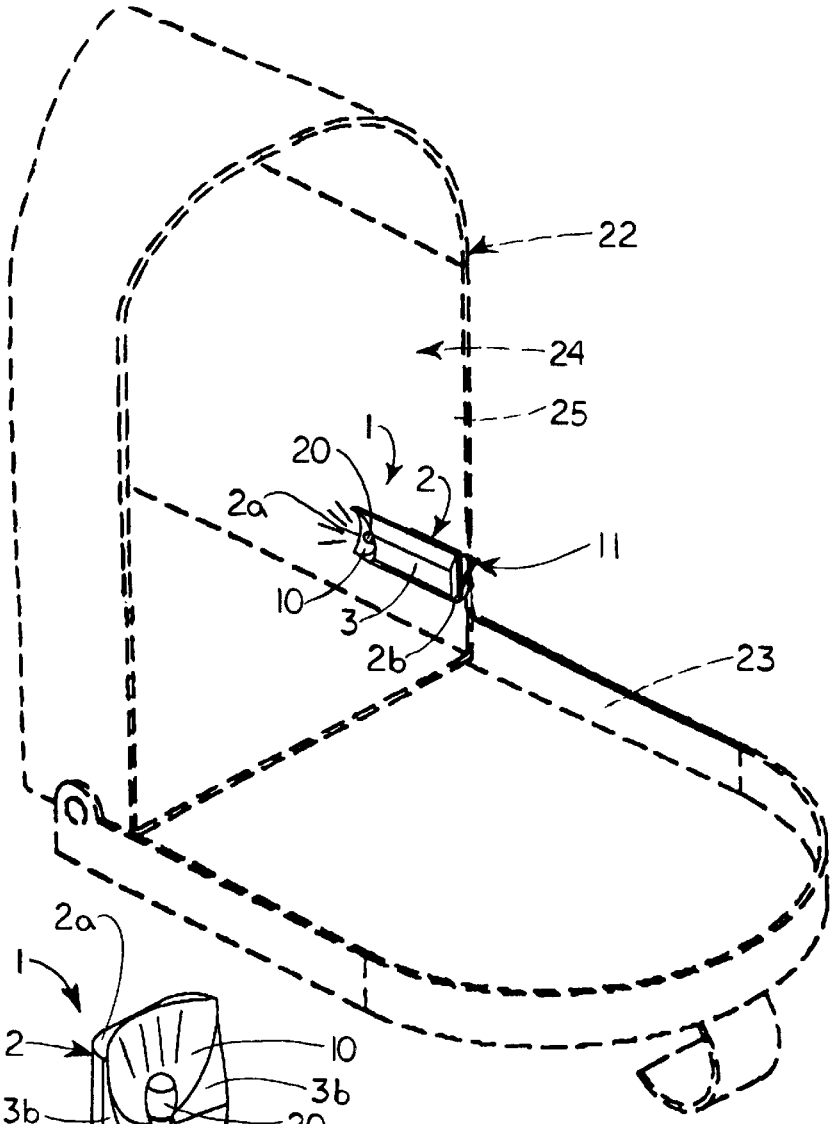
FIG. 1 is a perspective view of a preferred embodiment of the removable mailbox light of this invention, removably attached to a post-type mailbox (in-phantom) and illuminating the mailbox interior upon opening of the mailbox door.
Figure 2:
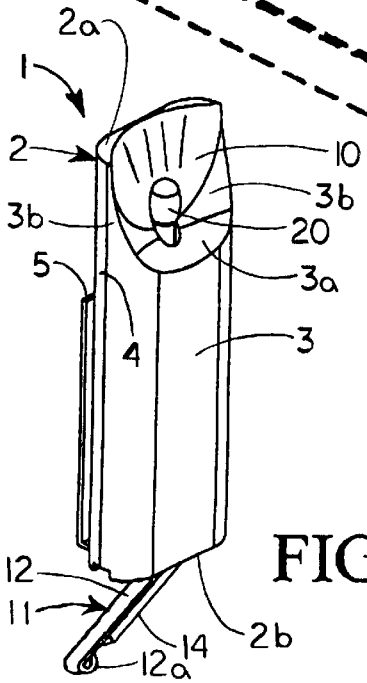
FIG. 2 is a left side perspective view of the removable mailbox light illustrated in FIG. 1, removed from the mailbox, with the activation clip element of the light shown in the extended configuration and the light bulb element energized.
Figure 3:
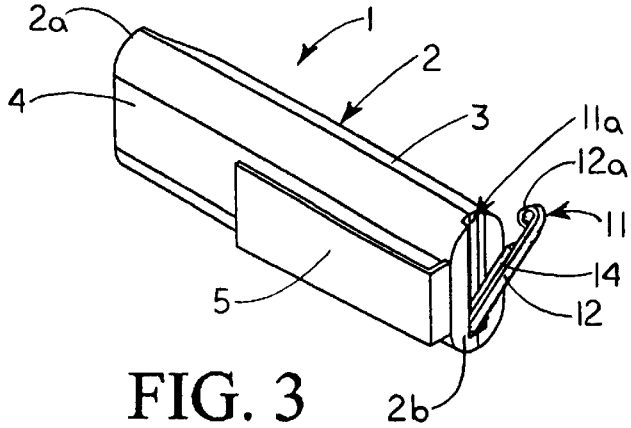
FIG. 3 is a right side perspective view of the removable mailbox light, in the illuminating configuration illustrated in FIG. 2.
Figure 8:
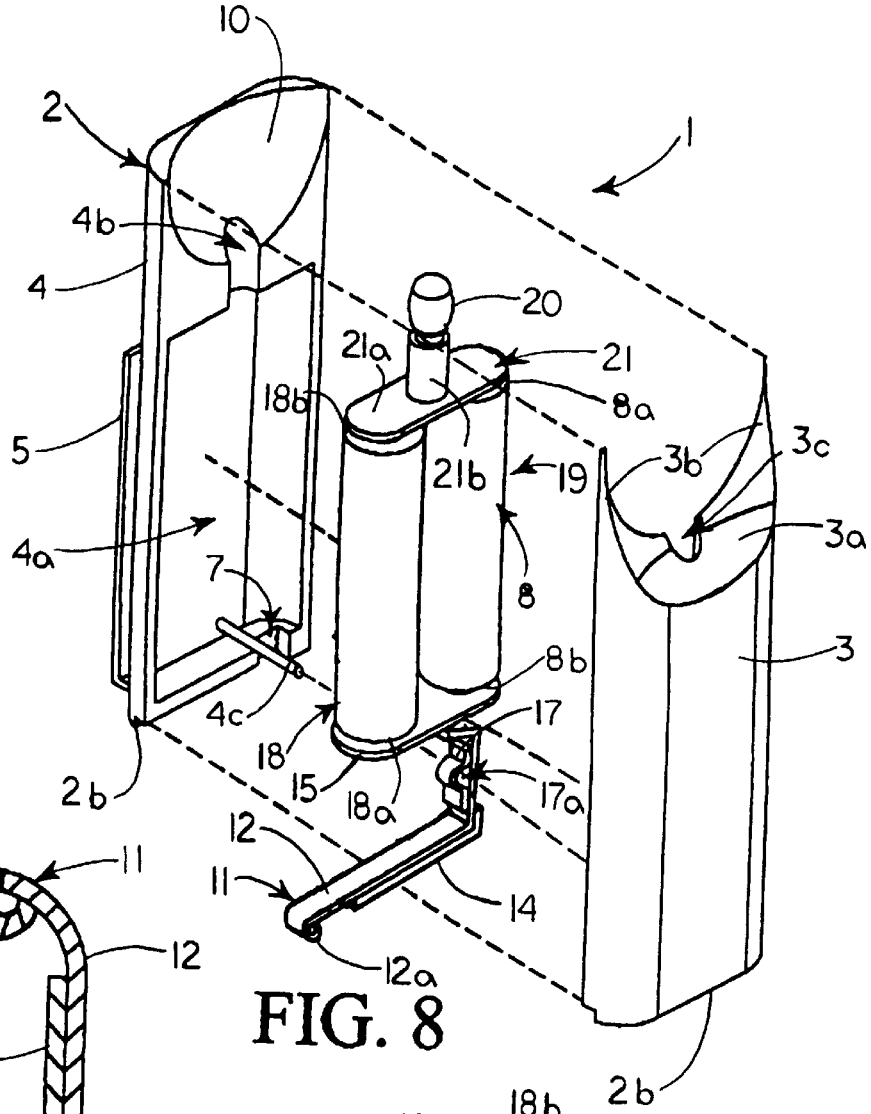
FIG. 8 is an exploded, perspective view of the removable mailbox light.
Figure 10:
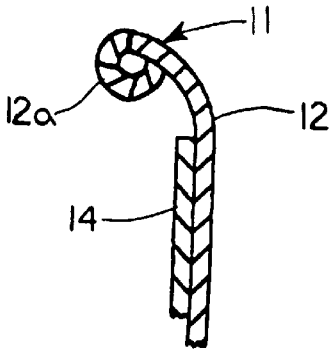
FIG. 10 is a longitudinal sectional view, partially in section, of the activation clip element of the removable mailbox light, with the looped, extending end portion of the activation clip shown optionally bended outwardly to facilitate enhanced contact of the activation clip with the mailbox door, as needed.

Referring initially to FIGS. 1–3, 5, 6, 8 and 9 of the drawings, in a preferred embodiment the removable mailbox light of this invention is generally illustrated by reference numeral 1. The removable mailbox light 1 is characterized by an elongated, generally rectangular, typically plastic housing 2, having a front end 2*a* and a rear end 2*b* and constructed of a left housing panel 3 which engages a complementary right housing panel 4 typically in a snap-fit, as illustrated in FIG. 8. The interior of the right housing panel 4 is characterized by a rectangular battery compartment 4*a* for containing a battery assembly 19, as hereinafter described. A neck seat 4*b* communicates with the battery compartment 4*a* in the right housing panel 4, and a generally beveled, concave or dish-shaped reflection surface 10 is shaped in the right housing panel 4 at the front end 2*a* of the housing 2, as illustrated in FIG. 2, the purpose of which neck seat 4*b* and reflection surface 10 will be hereinafter described. The left housing panel 3, similar in shape to the right housing panel 4 and having an interior battery compartment (not illustrated) complementary in size and shape to the battery compartment 4*a* of the right housing panel 4, is characterized by a left panel bevel 3*a* and a pair of spaced-apart, tapered panel extensions 3*b* that contribute to the concavity of the reflection surface 10 of the right housing panel 4 when the left housing panel 3 is attached to the right housing panel 4, as illustrated in FIG. 2. In a preferred embodiment, the reflective surface 10 of the right housing panel 4 and the left panel bevel 3*a* and panel extensions 3*b* of the left housing panel 3 are coated with a white or silver reflective paint or other light-reflective medium, according to the knowledge of those skilled in the art. A neck notch 3*c* (FIG. 8) is shaped in the left housing panel 3, between the panel extensions 3*b* for purposes which will be hereinafter described. As illustrated in FIG. 3, a flexible attachment clip 5 is provided on the outside surface of the right housing panel 4 for removably attaching the housing 2 to the right side wall 25 of the mailbox 22 in typical application of the removable mailbox light 1, as illustrated in FIG. 1 and hereinafter described. As illustrated in FIG. 3, the attachment clip 5 is generally flush with the flat rear end 2*b* of the housing 2, and is disposed on the housing 2 opposite the reflection surface 10, as illustrated in FIG. 2. As further illustrated in FIG. 3, an elongated clip depression 11*a* is formed along the center of the rear end 2*b* of the housing 2 by the mating left housing panel 3 and right housing panel 4, the purpose of which clip depression 11*a* will be hereinafter described. As illustrated in FIG. 8, a clip mount rod 4*c* extends from the right housing panel 4, into the battery compartment 4*a* and inserts in a rod receptacle (not illustrated), provided in the left housing panel 3, for purposes hereinafter described.

Figure 9:
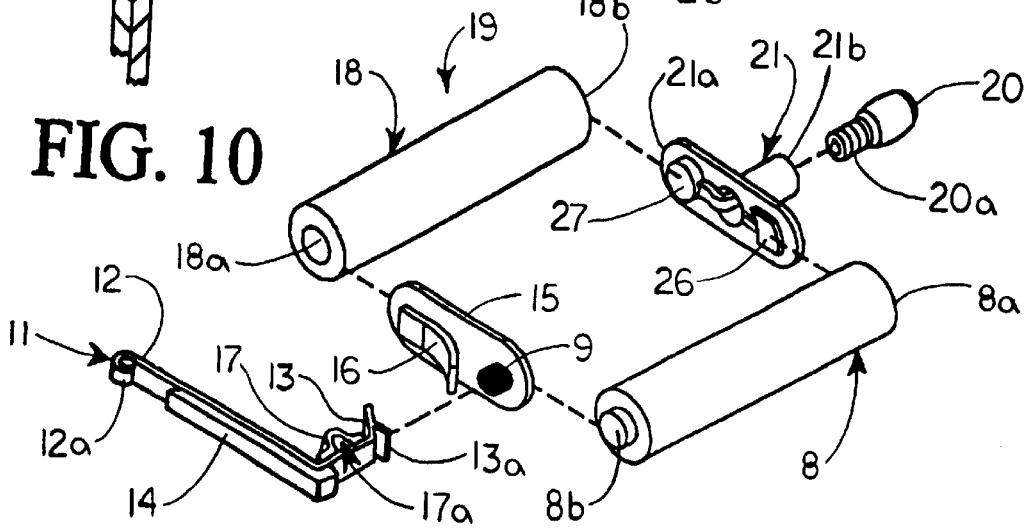
FIG. 9 is an exploded, perspective view of the preferred battery assembly of the removable mailbox light.

As illustrated in FIGS. 8 and 9, the battery assembly 19 is contained in the assembled housing 2 as hereinafter further described, and includes a first battery 8, having a negative terminal 8*a* and a positive terminal 8*b*; and a second battery 18, having a negative terminal 18*a* and a positive terminal 18*b*. A typically plastic bulb harness 21 of the battery assembly 19 includes an elongated, flat harness base 21*a* and a perpendicularly-extending harness neck 21*b*, which harness base 21*a* is fitted on the bottom end thereof with a metal negative contact 26 that engages the negative terminal 8*a* of the first battery 8, as illustrated in FIG. 9. The harness base 21*a* is further provided with a metal positive contact 27 which engages the positive terminal 18*b* of the second battery 18. The threaded bulb base 20*a* of a light bulb 20 is threaded into the harness neck 21*b* of the bulb harness 21. As further illustrated in FIG. 9, the negative contact 26 and positive contact 27 each extends from the bottom surface of the harness base 21*a* and terminates inside the harness neck 21*b* of the bulb harness 21, where the negative contact 26 establishes electrical contact between the negative terminal 8*a* of the first battery 8 and the bulb base 20*a* of the light bulb 20, and the positive contact 27 establishes electrical contact between the positive terminal 18*b* of the second battery 18 and the bulb base 20*a* of the light bulb 20.

As further illustrated in FIG. 9, an elongated, plastic spring mount plate 15 of the battery assembly 19 is fitted with a metal contact spring 9 which extends through a spring opening (not illustrated) provided in the spring mount plate 15 and is disposed in electrical contact with the positive terminal 8*b* of the first battery 8. As illustrated in FIG. 5, the cylindrical contact base 16*a* of a metal clip contact 16 extends through an opening (not illustrated) provided in the spring mount plate 15 and is disposed in electrical contact with the negative terminal 18*a* of the second battery 18. As illustrated in FIG. 8, the battery assembly 19 is seated in the battery compartment 4*a* of the right housing panel 4 and in the complementary battery compartment (not illustrated), provided in the left housing panel 3, with the harness neck 21*b* of the bulb harness 21 extending through the neck seat 4*b* of the right housing panel 4 and the neck notch 3*c* of the left housing panel 3. Accordingly, as illustrated in FIG. 2, the light bulb 20 is disposed adjacent to the reflection surface 10 of the right housing panel 4 and the left panel bevel 3*a* and panel extensions 3*b* of the left housing panel 3.

Referring next to FIGS. 3, 5, 6 and 9 of the drawings, an activation clip 11 is pivotally mounted on the clip mount rod 4*c* (FIG. 8) of the right housing panel 4, in the rear end 2*b* of the housing 2. As particularly illustrated in FIG. 9, the activation clip 11, constructed of an electrically-conductive metal, is characterized by a long segment 12, the extending end of which typically terminates in a loop 12*a*. An angled short segment 13 extends from the other end of the long segment 12, and is folded back to define a contact end 13*a*. An L-shaped, typically plastic sheath 14 is bonded or otherwise attached to the outside surfaces of the long segment 12 and short segment 13, respectively, of the activation clip 11. A curved clip mount strip 17 is provided on the short segment 13 of the activation clip 11 and defines a rod opening 17*a* (FIGS. 8 and 9), which receives the clip mount rod 4*c* of the right housing panel 4 to pivotally mount the activation clip 11 in the housing 2. The short segment 13 of the activation clip 11 extends through a left panel clip notch (not illustrated) and an aligned right panel clip notch 7 (FIG. 8), provided in the left housing panel 3 and attached right housing panel 4, respectively, of the housing 2 at the rear end 2*b* thereof, with the contact spring 9 attached to and engaging the contact end 13*a* of the activation clip 11, as illustrated in FIGS. 5 and 6. Accordingly, as illustrated in FIG. 5, the activation clip 11 can be pressed against the housing 2 with the long segment 12 thereof seated in the clip depression 11*a* (FIG. 3) of the housing 2, wherein the short segment 13 of the activation clip 11 disengages the clip contact 16, thereby breaking electrical contact between the positive terminal 8*b* of the first battery 8 and the negative terminal 18*a* of the second battery 18 and extinguishing the light bulb 20. As illustrated in FIG. 6, upon release, the activation clip 11 pivots on the clip mount rod 4*c* and extends from the clip depression 11*a* by operation of the contact spring 9, and the short segment 13 contacts the clip contact 16, thereby establishing electrical contact between the positive terminal 8*b* of the first battery 8 and the negative terminal 18*a* of the second battery 18 and energizing the light bulb 20.

Referring next to FIGS. 1, 4–6 and 10 of the drawings, in typical application the removable mailbox light 1 is attached to the right side wall 25 of a post-type mailbox 22 with the housing 2 extending into the mailbox interior 24, by inserting the right side wall 25 of the mailbox 22 between the attachment clip 5 and the outside surface of the right side panel 4, as illustrated in FIG. 4. Accordingly, the reflection surface 10, left panel bevel 3*a* and panel extensions 3*b* face the mailbox interior 24. When the mailbox door 23 of the mailbox 22 is in the closed position illustrated in FIG. 5, the mailbox door 23 presses the activation clip 11 against the rear end 2*b* of the housing 2, with the long segment 12 of the activation clip 11 seated in the clip depression 11*a* (FIG. 3) of the housing 2. The contact end 13*a* of the activation clip 11 compresses the contact spring 9 against the spring mount plate 15, and the short segment 13 of the activation clip 11 disengages the clip contact 16 of the battery assembly 19, thereby interrupting electrical contact between the first battery 8 and the second battery 18 to extinguish the light bulb 20, as heretofore described with respect to FIG. 5. Upon opening of the mailbox door 23 as illustrated in FIG. 6, the spring-biased activation clip 11 is released, whereupon the activation clip 11 pivots outwardly from the clip depression 11*a* (FIG. 3) of the housing 2 as the contact spring 9 urges the short segment 13 of the activation clip 11 into contact with the clip contact 16. The short segment 13 of the activation clip 11 therefore establishes electrical contact between the positive terminal 8*b* of the first battery 8 and the negative terminal 18*a* of the second battery 18, through the contact spring 9 and clip contact 16, to energize the light bulb 20. It will be appreciated from a consideration of FIGS. 1 and 4 that the beveled or concave reflection surface 10, in combination with the left panel bevel 3*a* and panel extensions 3*b*, reflects or scatters the light from the light bulb 20 to illuminate substantially the entire mailbox interior 24. Upon closing of the mailbox door 23, the mailbox door 23 pushes against the activation clip 11 at the loop 12*a* of the long segment 12 thereof to seat the long segment 12 in the clip depression 11*a* of the housing 2. Accordingly, as heretofore described with respect to FIG. 5, the short segment 13 of the activation clip 11 disengages the clip contact 16, against the bias of the contact spring 9 exerted against the contact end 13*a*, to break electrical contact between the first battery 8 and the second battery 18 and extinguish the light bulb 20. It will be appreciated from a consideration of FIG. 10 that the loop 12*a* end of the long segment 12 of the activation clip 11 can be bended beyond the plastic sheath 14 to enhance the contact capability of the activation clip 11 with the mailbox door 23, as needed in the event that the activation clip 11 partially loses its shape after repeated use.

Referring next to FIG. 7 and again to FIGS. 5 and 6 of the drawings, it will be appreciated by those skilled in the art that the removable mailbox light 1 can be easily removably attached to a porch-type mailbox 30, having a mailbox bottom 33, side walls (not illustrated), a rear wall (not illustrated), a front wall 32 and a lid 31, as illustrated in FIG. 7. Accordingly, the removable mailbox light 1 is removably mounted in the mailbox interior 24 by inserting one of the side walls (not illustrated) or the front wall 32, as illustrated, between the attachment clip 5 and the outside surface of the right housing panel 4 of the housing 2 with the reflection surface 10, left panel bevel 3*a* and panel extensions 3*b* facing the mailbox interior 24, as illustrated. When the mailbox lid 31 is closed, as illustrated, the activation clip 11 is pressed against the housing 2 with the long segment 12 thereof seated in the clip depression 11*a* (FIG. 3) of the housing 2, and the short segment 13 of the activation clip 11 disengages the clip contact 16 and the light bulb 20 is extinguished, as heretofore described with respect to FIG. 5. Upon raising the mailbox lid 31, the activation clip 11 is released and assumes the extended configuration illustrated in FIG. 6, wherein the contact spring 9 urges the short segment 13 of the activation clip 11 into contact with the clip contact 16 to establish electrical contact between the first battery 8 and the second battery 18, thereby energizing the light bulb 20 and illuminating the mailbox interior 24.

It will be appreciated by those skilled in the art that the removable mailbox light of this invention is simple in construction and easy to install and remove on all types of mailboxes, and requires no modification of the mailbox to achieve this purpose. While in a preferred embodiment the removable mailbox light 1 is disposable and the housing 2 is assembled by snap-fitting the left housing panel 3 and right housing panel 4 together, it is understood that the left housing panel 3 and right housing panel 4 can be removably attached to each other by means of screws or any other suitable technique known to those skilled in the art in order to facilitate replacing the first battery 8 and second battery 18, as needed.

Referring again to FIGS. 5, 6 and 9 of the drawings, it is understood that the removable mailbox light 1 of this invention can be constructed using light bulbs 20 of any suitable type, including those capable of being energized using one battery. In that case, the first battery 8 is provided in electrical contact with the light bulb 20 through the negative contact 26 (FIG. 9) of the bulb harness 21, and in electrical contact with the activation clip 11 through the contact spring 9, as heretofore described with respect to FIGS. 5 and 6, except the second battery 18 is omitted from the battery assembly 19 and the clip contact 16 is provided in direct electrical contact with the light bulb 20, through the positive contact 27 (FIG. 9) of the bulb harness 21.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. A removable mailbox light for removable attachment to a mailbox having a mailbox interior closed by a mailbox door, said removable mailbox light comprising:

a housing;

an attachment clip provided on said housing for removably attaching said housing to the mailbox;

a light bulb extending from said housing;

a battery provided in said housing and in electrical contact with said light bulb;

a contact spring provided in electrical contact with said light bulb; and an activation clip pivotally mounted on said housing and engaging said contact spring for removable electrical contact with said battery, wherein the mailbox door pivots said activation clip away from electrical contact with said battery and said light bulb is extinguished when the mailbox door is closed, and said contact spring pushes said activation clip into contact with said batty and said light bulb is energized when the mailbox door is opened.

2. The removable mailbox fight of claim 1 comprising an angled reflective surface provided on said housing adjacent to said light bulb for reflecting light from said light bulb.

3. The removable mailbox light of claim 1 comprising a clip depression provided in said housing for receiving said activation clip when the mailbox door is closed.

4. The removable mailbox light of claim 3 comprising an angled reflective surface provided on said housing adjacent to said light bulb for reflecting light from said light bulb.

5. The removable mailbox light of claim 1 wherein said housing comprises a bottom housing panel and a top housing panel removably mounted on said bottom housing panel.

6. The removable mailbox light of claim 5 comprising an angled reflective surface provided on said housing adjacent to said light bulb for reflecting light from said light bulb.

7. The removable mailbox light of claim 5 comprising a clip depression provided in said housing for receiving said activation clip when the mailbox door is closed.

8. The removable mailbox light of claim 7 comprising an angled reflective surface provided on said housing adjacent to said light bulb for reflecting fight from said light bulb.

9. A removable mailbox light for removable attachment to a mailbox having a mailbox interior closed by a mailbox door, said removable mailbox light comprising:

a housing;

an attachment clip provided on said housing for removably attaching said housing to the mailbox;

a light bulb extending from said housing;

a first battery provided in said housing and in electrical contact with said light bulb;

a contact spring provided in electrical contact with said first battery;

a second battery provided in said housing and in electrical contact with said light bulb; and an activation clip pivotally mounted on said housing and engaging said contact spring for removable electrical contact with said second battery, wherein the the mailbox door pivots said activation clip away from electrical contact with said second battery and said light bulb is extinguished when the mailbox door is closed, and said contact spring pushes said activation clip into contact with said second battery and said light bulb is energized when the mailbox door is opened.

10. The removable mailbox light of claim 9 comprising an angled reflective surface provided on said housing for reflecting light from said light bulb.

11. The removable mailbox light of claim 9 comprising a clip depression provided in said housing for receiving said activation clip when the mailbox door is closed.

12. The removable mailbox light of claim 11 comprising an angled reflective surface provided on said housing for reflecting light from said light bulb.

* * * * *